US008633866B2

(12) United States Patent
Sarabandi et al.

(10) Patent No.: US 8,633,866 B2
(45) Date of Patent: Jan. 21, 2014

(54) FREQUENCY-SELECTIVE SURFACE (FSS) STRUCTURES

(75) Inventors: Kamal Sarabandi, Ann Arbor, MI (US); Farhad Bayatpur, Ann Arbor, MI (US)

(73) Assignee: The Regents of the University of Michigan, Ann Arbor, MI (US)

( * ) Notice: Subject to any disclaimer, the term of this patent is extended or adjusted under 35 U.S.C. 154(b) by 172 days.

(21) Appl. No.: 12/792,827

(22) Filed: Jun. 3, 2010

(65) Prior Publication Data

US 2011/0210903 A1 Sep. 1, 2011

Related U.S. Application Data

(60) Provisional application No. 61/308,801, filed on Feb. 26, 2010.

(51) Int. Cl.
*H01Q 15/02* (2006.01)

(52) U.S. Cl.
USPC ..... 343/909

(58) Field of Classification Search
USPC ..... 343/909, 700 MS, 753, 754, 745, 748, 343/741, 866; 333/134, 202
See application file for complete search history.

(56) References Cited

U.S. PATENT DOCUMENTS

| | | | | | |
|---|---|---|---|---|---|
| 4,814,785 | A * | 3/1989 | Wu | 343/909 |
| 5,373,302 | A * | 12/1994 | Wu | 343/781 P |
| 5,497,169 | A * | 3/1996 | Wu | 343/909 |
| 5,949,387 | A * | 9/1999 | Wu et al. | 343/909 |
| 6,396,451 | B1 * | 5/2002 | Wu et al. | 343/756 |
| 6,822,622 | B2 * | 11/2004 | Crawford et al. | 343/909 |
| 7,071,889 | B2 * | 7/2006 | McKinzie et al. | 343/756 |
| 7,382,222 | B1 * | 6/2008 | Manetakis | 336/200 |
| 7,420,524 | B2 * | 9/2008 | Werner et al. | 343/909 |
| 7,639,206 | B2 * | 12/2009 | Behdad | 343/909 |
| 2009/0058746 | A1 * | 3/2009 | Delgado et al. | 343/770 |

* cited by examiner

*Primary Examiner* — Hoang V Nguyen
(74) *Attorney, Agent, or Firm* — Reising Ethington P.C.

(57) ABSTRACT

Frequency-selective surface (FSS) structures that may be used in a variety of different filtering capacities and applications. According to exemplary embodiments, there is disclosed: 1) a one-sided FSS structure that has a conductive grid and conductive loops located on the same side of a thin substrate and exhibits a single pole frequency response; 2) a multiple layer FSS structure that has several one-sided FSS layers and exhibits a multiple pole frequency response; 3) a loop/loop tunable FSS structure where the frequency response can be adjusted or tuned with a bias network; 4) a grid/grid tunable FSS structure where the frequency response can be adjusted or tuned without the use of bias network; and 5) an antenna arrangement that has a FSS structure placed over top of antenna array so that the need for separate components, like bulky filters in a transceiver chain, can be eliminated.

17 Claims, 11 Drawing Sheets

FREQUENCY-SELECTIVE SURFACE (FSS) STRUCTURES

CROSS-REFERENCE TO RELATED APPLICATION

This application claims the benefit of U.S. Provisional Application No. 61/308,801, filed Feb. 26, 2010, the entire contents of which are hereby incorporated by reference.

TECHNICAL FIELD

The invention generally relates to periodic structures and their applications in radio wave and optical frequencies and, more particularly, to improvements in frequency-selective surface (FSS) structures that may be used in a variety of different spatial filtering capacities and applications.

SUMMARY OF THE INVENTION

According to one aspect, there is provided a frequency-selective surface (FSS) structure, comprising: a conductive grid; a plurality of conductive loops being located within the conductive grid; and a thin substrate. The conductive grid and the plurality of conductive loops are both located on the same side of the thin substrate, and the FSS structure exhibits a single pole frequency response.

According to another aspect, there is provided a frequency-selective surface (FSS) structure, comprising: a first FSS layer having a first conductive grid and a first plurality of conductive loops, wherein the first conductive grid and the first plurality of conductive loops are both located on a first plane; a second FSS layer having a second conductive grid and a second plurality of conductive loops, wherein the second conductive grid and the second plurality of conductive loops are both located on a second plane; and a thin substrate located between the first and second planes. The first and second planes are spaced such that the first and second FSS layers are electromagnetically coupled to one another, and the FSS structure exhibits a multiple pole frequency response.

According to another aspect, there is provide a tunable frequency-selective surface (FSS) structure, comprising: a first FSS layer having a first loop array; a second FSS layer having a second loop array; a thin substrate being located between the first and second FSS layers; and at least one bias network having a plurality of varactor diodes. The first and second FSS layers are spaced such that the first and second loop arrays are electromagnetically coupled to one another, and the tunable FSS structure exhibits a frequency response that can be tuned with the bias network.

According to another aspect, there is provided a tunable frequency-selective surface (FSS) structure, comprising: a first FSS layer having a first conductive grid; a second FSS layer having a second conductive grid; a thin substrate being located between the first and second FSS layers; and a plurality of varactor diodes connecting the first and second conductive grids together. The first and second FSS layers are spaced such that the first and second conductive grids are electromagnetically coupled to one another, and the FSS structure exhibits a frequency response that can be tuned without a bias network.

According to another aspect, there is provided an antenna arrangement, comprising: a frequency-selective surface (FSS) structure having a loop array, a conductive grid, and a thin substrate, the loop array is located on one side of the thin substrate and the conductive grid is located on another side of the thin substrate; an antenna array having a plurality of antenna elements; and a dielectric spacer located between the FSS structure and the antenna array. The FSS structure is located over top of the antenna array such that electromagnetic waves incident upon or radiating from the antenna elements are filtered by the FSS structure.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Frequency selective surface (FSS) structures can be thought of as the free-space counterparts of filters in a transmission line. Once exposed to electromagnetic signals, an FSS structure may act like a filter (traditional FSS structures typically exhibit filtering behavior that is a function of the angle of incidence of the electromagnetic signals). FSS structures can be made up of planar, periodic conductive grids and loop arrays printed on dielectric substrates. Some FSS structures are based on electromagnetic resonance of a unit cell that has dimensions or perimeters that are integer multiples of a half wavelength ($\lambda/2$) or full wavelength ($\lambda$), respectively.

A new approach for designing FSS structures has been proposed where, instead of using conventional resonant unit cells as the building blocks of the FSS, smaller unit cells are used that have dimensions on a sub-wavelength level. These miniaturized element frequency-selective surfaces (MEFSS), as they are sometimes called, can interact with an incident wave in the fundamental transverse electromagnetic (TEM) mode such that they exhibit certain capacitive and/or inductive properties. By selecting and arranging these sub-wavelength structures properly, coupling among different FSS layers or among structures within a single FSS layer may be utilized to achieve a desired frequency response. Moreover, this frequency response is less sensitive to the angle of incidence of the electromagnetic signals being filtered; a feature that may be useful in a variety of applications, including various antenna applications. These capacitive and/or inductive properties are possible in the sub-wavelength regime, even where the unit cells are on the order of $\lambda/10$ or smaller.

The following description introduces and discusses several embodiments and/or implementations of a frequency-selective surface (FSS), including: 1) a one-sided FSS structure that has a conductive grid and conductive loops located on the same side of a thin substrate and exhibits a single pole frequency response; 2) a multiple layer FSS structure that has several one-sided FSS layers and exhibits a multiple pole frequency response; 3) a loop/loop tunable FSS structure where the frequency response can be adjusted or tuned with a bias network and with respect to the mode of operation (e.g., can change between bandstop and bandpass), the center frequency and/or the bandwidth; 4) a grid/grid tunable FSS structure where the frequency response can be adjusted or tuned without the use of bias network; and 5) an antenna arrangement that has a FSS structure or layer placed over top of an antenna array so that the need for separate components, like bulky filters in a transceiver chain, can be eliminated.

One-Sided FSS Structure

Figure 1:
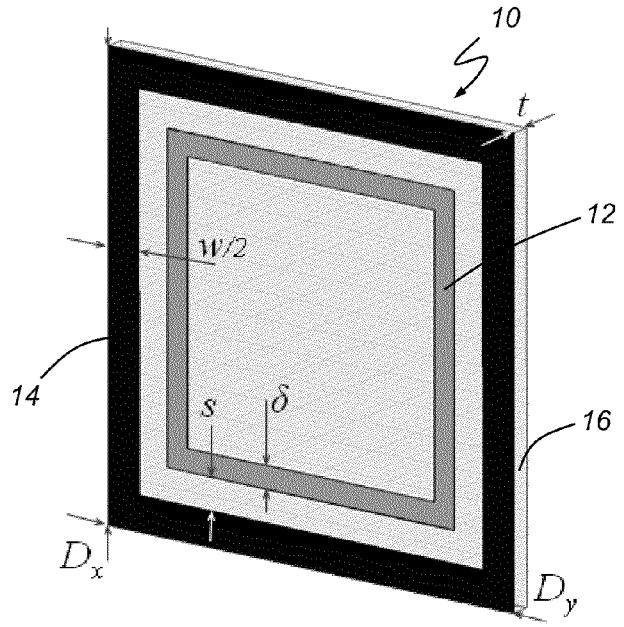
FIG. 1 is an illustration of an exemplary unit cell of a one-sided frequency selective surface (FSS) structure with sub-wavelength components.

With reference to FIG. 1, there is shown an exemplary unit cell for a FSS structure 10 that only occupies a single side of a substrate; i.e., a one-sided FSS structure. According to an exemplary embodiment, FSS structure 10 includes a number of conductive loops 12 and a conductive grid 14 mounted or otherwise fabricated on the same side of a thin substrate 16. FSS structure 10 may exhibit desired characteristics including a single pole frequency response having a passband and a transmission zero, but it only has one printed surface and therefore is more suitable for thin, multiple layer applications. An additional conductive grid and conductive loops can be added to the other side of thin substrate 16 (a second FSS layer) to form a multiple layer FSS structure exhibiting a multiple pole frequency response, as will be subsequently explained. Skilled artisans will appreciate that FIG. 1 only illustrates a single, exemplary unit cell and that a typical FSS structure will likely include many unit cells arranged in a periodic or grid-like fashion that spread out over a surface area. Thus, references herein to an "FSS structure" usually refer to a structure having a number of unit cells and not just a single unit cell, as illustrated in FIG. 1.

Multiple pole FSS structures can be designed by stacking or cascading a number of single pole FSS layers on top of each other. Although this method is somewhat straightforward, the fabrication process might become difficult if the thicknesses of the constituent FSS layers increase and/or if the FSS layers have separate discrete capacitive and/or inductive elements; that is, separate physical elements or components. To address these two potential issues, FSS structure 10 has the conductive loops 12 and the conductive grid 14 located on the same side or surface of thin substrate 16 (i.e., one-sided or co-planar FSS layer), and generates the desired frequency response without the need for separate discrete capacitive and/or inductive elements. This is different, for example, than a two-sided FSS layer where conductive loops and a conductive grid are located on opposite sides of a substrate.

Figure 2:
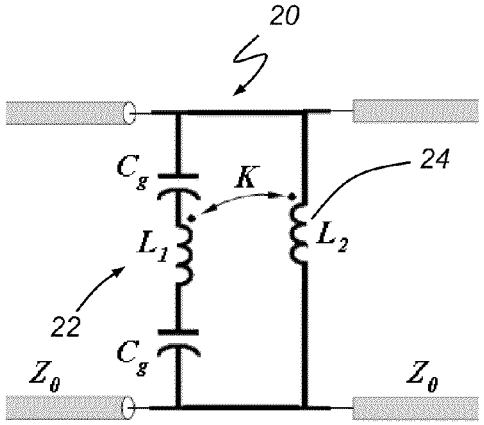
FIG. 2 is a schematic view of an equivalent circuit model for the exemplary one-sided FSS structure of FIG. 1.

FSS structure 10 has the conductive loops 12 and the conductive grid 14 fabricated or otherwise located on the same general plane (FIG. 1 only shows a single unit cell even though a FSS structure would likely include many unit cells). According to this particular embodiment, each conductive loop 12 is a square cell and is located within a square cell of conductive grid 14 such that there is uniform spacing (s) between the conductive loop and the conductive grid. This 'loops-within-the-grid' arrangement may be carried out on a periodic basis across an entire FSS layer; FIG. 1 only showing a single unit cell of such an arrangement. The conductive loops 12 and/or the conductive grid 14 may be made from any suitable conductive material and may be deposited or otherwise formed on thin substrate 16 according to any suitable fabrication technique. This includes, for example, providing the conductive loops 12 and/or the conductive grid in the form of copper traces made with known PCB fabrication methods. For this topology, a representative circuit model 20 is shown in FIG. 2 which includes a notch branch 22 in parallel with an inductor 24. There are differences between circuit model 20 and the equivalent circuit of a two-sided FSS structure, since the conductive loops and grid in FSS structure 10 are fabricated on the same plane or side of substrate 16 as opposed to different sides. One potential difference between one-sided and two-sided FSS structures is the lack of a series or junction capacitor between the loop and grid elements of the one-sided structure. Another potential difference is that the electromagnetic coupling coefficient is changed, and a free parameter that could control the electromagnetic coupling (spacing between the loop and the grid) may be lost.

Figure 3:
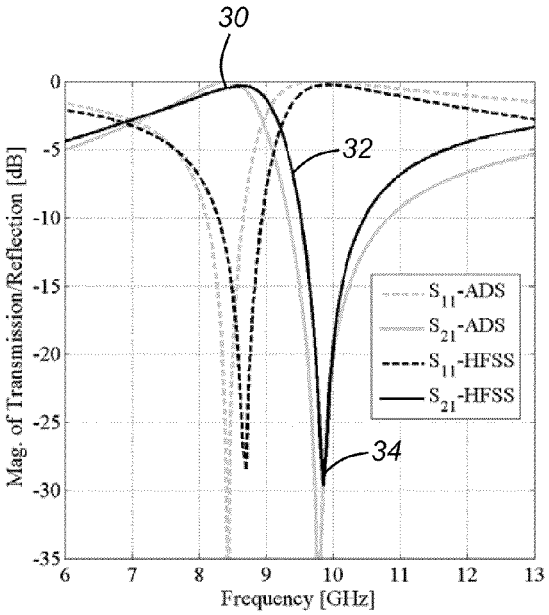
FIG. 3 is a graph comparing the frequency response of the actual exemplary one-sided FSS structure of FIG. 1 with that of the equivalent circuit model of FIG. 2.

The full-wave simulation results using Ansoft HFSS (simulation of actual FSS structure 10), compared to the simulation results using Agent Directed Simulation (ADS) (simulation of equivalent circuit model 20), are shown in the graph of FIG. 3. The graph for $S_{11}$-ADS represents a reflected signal for the equivalent circuit model; the graph for $S_{21}$-ADS represents a transmitted signal for the equivalent circuit model; the graph for $S_{11}$-HFSS represents a reflected signal for the actual FSS structure; and the graph for $S_{21}$-HFSS represents a transmitted signal for the actual FSS structure. As demonstrated by the graph, representative circuit model 20 rather accurately models or predicts the frequency response of the actual one-sided FSS structure 10. With reference to FIGS. 1 and 3, the following values were used for the HFSS simulation: s=0.1 mm, δ=0.106 mm, w=0.365 mm, t=0.125 mm, $\in_r$=2.2, and $D_x$=$D_y$=6.9 mm; and the following values were used for representative circuit model simulation: $C_g$=0.21 pF, $L_1$=3 nH, $L_2$=2.65 nH, K=0.4, and $Z_0$=377Ω. Given the equivalent circuit model 20, approximate inductive and capacitive content required for FSS structure 10 to generate a bandpass frequency response, similar to that of the model, can be determined. After choosing the values of the circuit parameters that enable a bandpass frequency response at X-band, the unit cell shown in FIG. 1 can be optimized. This process may be done using a full-wave solver, for example. According to an exemplary embodiment, conductive grid 14 includes a number of square cells that each has a sub-wavelength outer dimension ($D_x$, $D_y$), and each of the conductive loops 12 is a square cell that has a sub-wavelength outer dimension that is smaller than that of the corresponding grid square cell; that is, the conductive loop square cells are located inside of the conductive grid square cells. In an exemplary embodiment, the outer dimensions ($D_x$, $D_y$) for the square cells of both the conductive grid and the conductive loops are less than or equal to one tenth of the wavelength (λ/10) of the electromagnetic signals being filtered, and the spacing (s) between the conductive loops and the conductive grid is uniform and is equal to or less than λ/100. Those skilled in the art will appreciate that the above-listed parameters, values, dimensions, etc. are only exemplary and that others could certainly be used instead.

With reference to FIG. 3, FSS structure 10 may exhibit a single pole frequency response that acts as a bandpass filter and includes a passband 30, a fast roll-off 32 near the upper end of the passband, and a notch or transmission zero 34. With reference to the $S_{21}$-HFSS graph in FIG. 3 (i.e., the transmitted signal for the actual FSS structure), it can be seen that a passband 30 occurs, followed by a steep and sharp roll-off 32 which marks the end of the passband range and terminates in a transmission zero 34. The one-sided FSS structure 10 is thin enough that it can be stacked, cascaded or otherwise arranged in a multiple layer FSS structure in order to produce a multiple pole frequency response, as will be explained. This multiple pole frequency response may be a high order response with sharp and crisp filtering or a multiple band response with several passbands and/or stopbands, for example. It should be appreciated that FSS structure 10 may exhibit a single pole frequency response in the form of either a single bandpass filter or a single bandstop filter, and is not limited to the bandpass example shown in FIG. 3.

A common technique in filter theory for achieving higher order filtering or frequency response, as mentioned above, involves using a number of single or first order resonators coupled with each other. By tuning the resonators as well as the levels of coupling, the multiple order characteristics of the filter can be adjusted.

Multiple Layer FSS Structure

In this section, multiple layer FSS structures exhibiting multiple pole frequency responses are described, where the multiple layer FSS structure can be based on the exemplary one-sided FSS structure shown in FIG. 1. As mentioned above, lumped capacitors and/or inductors interconnecting the conductive loops in an FSS structure may cause fabrication problems for multiple layer constructions. One-sided FSS structure 10 is designed to reduce the required capacitance such that the gap capacitance itself is sufficient to maintain the filter characteristics. By eliminating discrete and separate capacitive and/or inductive elements, a multiple layer FSS structure with a multiple pole frequency response can be more easily fabricated.

Figure 4:
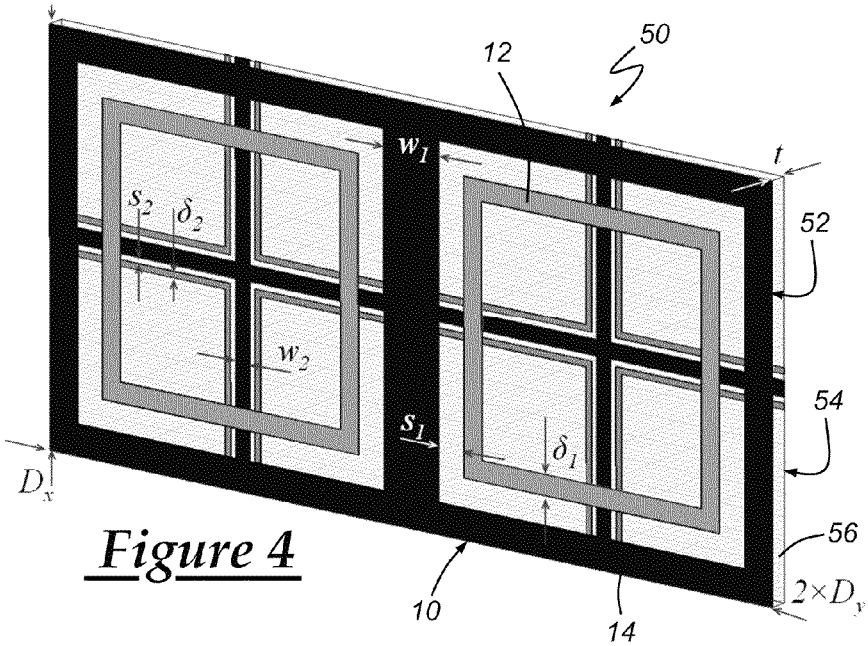
FIG. 4 is an illustration of several exemplary unit cells of a multiple layer FSS structure.

According to the exemplary embodiment shown in FIG. 4, a multiple layer FSS structure 50 exhibits a multiple pole frequency response and includes first and second FSS layers 52, 54 printed or otherwise formed on different sides of a thin substrate 56. Each FSS layer may include a number of the unit cells from the one-sided FSS structure 10 including conductive loops 12 and a conductive grid 14. Multiple layer FSS structure 50 may be used as a high order filter or a multiple band filter, as will be explained. Two unit cells from one-sided FSS structure 10 are shown on FSS layer 52 (the front layer), and portions of six unit cells are shown on FSS layer 54 (the back layer). As shown, the two FSS layers 52, 54 are laterally shifted with respect to one another by half of a unit cell in both ˆx and ˆy directions. It is also possible for the two FSS layers 52, 54 to not be shifted at all, such that they are stacked directly on top of each other. For this exemplary arrangement, the overall thickness of thin substrate 56 can be less than or equal to one hundredth of the wavelength (λ/100) of the electromagnetic waves being filtered. The thinner the substrate the more electromagnetic coupling that occurs between first and second FSS layers, as they are closer together. A first side of substrate 56 is covered with first FSS layer 52—whose parameters in this exemplary embodiment are: $s_1$=0.1 mm, $\delta_1$=0.106 mm, $w_1$=0.365 mm, t=0.125 mm, $\in_r$=2.2, and $D_x$=$D_y$=6.9 mm. Having the same period as that of the first FSS layer, second FSS layer 54 covers the other side of the two-sided substrate 56 and may use the same or different parameter values. In an exemplary embodiment, the parameters for the second FSS layer 54 include: s2=0.48 mm, $\delta_2$=0.34 mm and $w_2$=0.54 mm. These parameters are, of course, only exemplary and can certainly be changed in order to accommodate the particular needs of the application.

Multiple layer FSS structure 50 may be formed by cascading, stacking or otherwise arranging two or more FSS layers or structures on top of each other, such as the exemplary one-sided FSS structure 10 that is shown in FIG. 1. In such an embodiment, the multiple layer FSS structure 50 may exhibit a multiple pole frequency response, where the one-sided FSS layers that act as the building blocks for such a structure may individually exhibit a single pole frequency response. In the process presented here, the parameters used for optimization are the substrate thickness and the lateral placement of the one-sided FSS layers in the multiple layer FSS structure 50 (i.e., the relative lateral position of one layer with respect to the other). Thus, a designer can control the coupling between the two one-sided FSS layers 52, 54 by simply adjusting or manipulating the substrate thickness and/or the lateral position of the two FSS layers. Although a multiple layer FSS structure is described below in terms of the exemplary embodiment shown in FIG. 4, other multiple layer FSS structures are also possible. For example, a multiple layer FSS structure could be provided that has: different layers with different conductive loop and/or conductive grid geometries, different layers with different conductive loop and/or conductive grid dimensions, different layers with different spacer thicknesses in between, and more FSS layers than the exemplary two-layer version shown here. Other changes and alternative embodiments are possible as well.

As mentioned above, the mutual electromagnetic coupling between the one-sided FSS layers 52, 54 may be an important optimization parameter in the multiple layer FSS design process. Two exemplary multiple layer FSS structures are described, including: 1) a first structure with two one-sided FSS structures or layers that are laterally shifted by half of a unit cell with respect to each other along ˆx and ˆy directions (i.e., the embodiment of FIG. 4 where the center of a unit cell of the top FSS layer 52 is located over top of the corner of a unit cell of the bottom FSS layer 54), and 2) a second structure with two one-sided FSS structures or layers that are stacked without any lateral shift (not shown). In this way, the variation in the coupling coefficient is used to split the poles to get either a multiple band frequency response (non-shifted embodiment) or to bring the poles close to each other to produce a higher order response (shifted embodiment). It should be appreciated that maintaining the FSS layers without a shift does not always produce a multiple band frequency response, and that shifting them does not always produce a higher order response. The overall frequency response of multiple layer FSS structure 50 may be affected by numerous parameters, including the geometry and size of the various elements involved. These multiple layer FSS structures may have a center of symmetry located at the center of the spacer box. For example, their top and bottom FSS layers may be covered with the same loop arrays or different loop arrays. The multiple layer FSS structure 50 with its multiple pole frequency response may include two of the same one-sided FSS layers 10 whose circuit model is already known. It is possible for the two FSS layers to be the same (i.e., have unit cells with the same geometries and dimensions) or to be different.

As mentioned above, one objective may be to reduce the thickness of multiple layer FSS structures with multiple pole frequency responses, which in turn can reduce the complexity and cost of fabrication and improve their performance. Multiple layer FSS structures that are comprised of several two-sided FSS structures, as opposed to several one-sided FSS structures like structure 10, have an increased thickness. As discussed previously, this might be impractical for multiple layer FSS applications with multiple pole frequency responses where a very low thickness is required.

Figure 5:
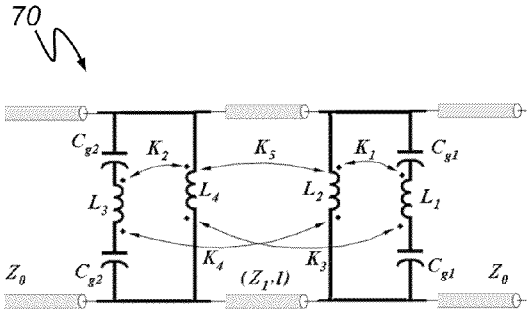
FIG. 5 is a schematic view of an equivalent circuit model for the exemplary multiple layer FSS structure of FIG. 4.

In FIG. 5, the equivalent circuit model 70 of multiple layer FSS structure 50 at normal incidence is shown, where the FSS structure includes two one-sided FSS structures 10 arranged in a laterally offset manner. An equivalent circuit model for multiple layer FSS structure 50 can be obtained by cascading the circuit models of its individual FSS layers 52, 54 and incorporating appropriate coupling coefficients into the circuit to model the electromagnetic interactions between the two FSS layers. Given the small distance between first and second FSS layers 52, 54, they may be highly coupled. The new elements accounting for the coupling of the FSS layers are K3, K4, and K5, as shown in the equivalent circuit model 70 of FIG. 5. Using the same values provided above for the circuit models of the FSS layers, this circuit well predicts the full-wave simulation results (see FIG. 6). The right half of circuit 70 is the first FSS layer 52 whose values are: $C_{g1}$=0.21 pF, $L_1$=3 nH, $L_2$=2.65 nH, $K_1$=0.4, and $Z_0$=377Ω; and the left half of the circuit is the second FSS layer 54 whose values are: $C_{g2}$=0.1 pF, $L_3$=2.6 nH, $L_4$=2.6 nH, and $K_2$=0.05. The coupling between the two single pole circuits (i.e., the two FSS layers) is shown through the coefficients $K_3$=0.1, $K_4$=−0.05, and $K_5$=0.15, and the substrate is characterized by: ($Z_1$=250Ω, l=10°) at 10 GHz.

Figure 6:
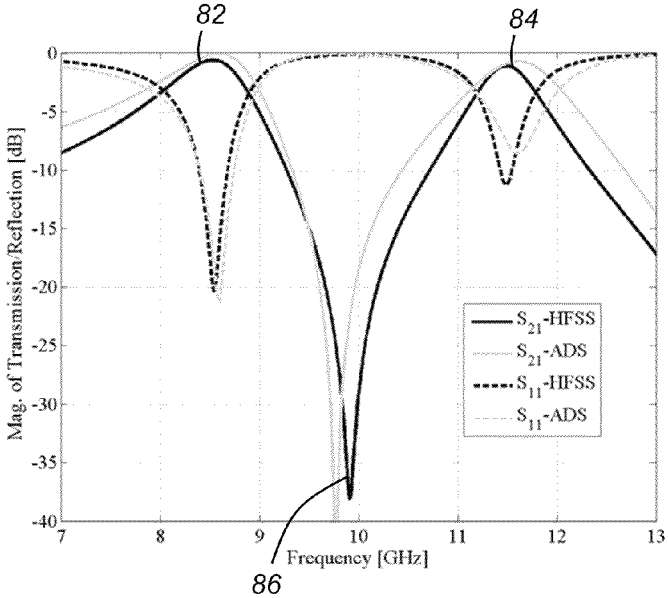
FIG. 6 is a graph comparing the frequency response of the actual exemplary multiple layer FSS structure of FIG. 4 with that of the equivalent circuit model of FIG. 5.

The simulation results for multiple layer FSS structure 50 are shown in FIG. 6 and demonstrate a remarkable improvement in terms of the out-of-band rejection or transmission zero compared to other FSS structures. It should be emphasized that this multiple layer FSS structure, which may be used as a dual-bandpass filter, can be six times thinner than a multiple layer FSS structure that uses several two-sided FSS layers. As mentioned above, no lateral shift in FSS layers 52, 54 can result in a multiple band frequency response like the dual bandpass frequency response shown in FIG. 6. In this particular case, two passbands 82, 84 are shown with a sharp and significant roll-off and transmission zero 86 between them. If the two FSS layers 52, 54 were laterally shifted with respect to one another (not shown), then it is possible for the multiple layer FSS structure to exhibit a multiple pole frequency response that includes a single passband that is sharper than single pole responses and has a maximally flat top (i.e., a higher order frequency response).

As explained above, a one-sided FSS structure 10 may be used as a building block for a multiple layer FSS structure 50 that exhibits a multiple pole frequency response, including ones where the different FSS layers are laterally shifted or offset and ones where they are not. The multiple layer FSS structure 50 can be quite thin (e.g., less than or equal to λ/100 or even less than or equal to λ/240, in some cases) compared to multilayer FSS structures that use several two-sided FSS layers, and it displays good out-of-band rejection characteristics.

All of the numbers, dimensions, parameters, test results, etc. provided above are purely for purposes of illustration and the invention is not limited thereto.

Tunable Frequency-Selective Surface (FSS) Structure with Bias Network

A tunable or reconfigurable frequency-selective surface (FSS) structure 100 is presented that includes two periodic arrays of conductive loops on different sides of a thin dielectric substrate. Using solid-state varactor diodes, tunable Barium Strontium Titanate (BST) capacitors, or any other similar component (hereafter, collectively referred to as "varactors"), tunable FSS structure 100 may exhibit a reconfigurable frequency response that has several different adjustable characteristics: the mode of operation can be changed between bandstop and bandpass, the center frequency can be adjusted or tuned, and the bandwidth can be adjusted or tuned. These different characteristics may be altered independently of each other.

Tunable FSS structure 100 may act as a tunable spatial filter whose frequency response can be switched between bandpass and bandstop. The design approach begins with developing a realizable concept for the desired tunable FSS structure 100. It will be convenient if the frequency response be realizable from modular components to generate the desired frequency response over sub-regions. This decomposition will allow structures associated with each sub-region be designed and then predictably brought together to make the desired frequency or filter response. In the following discussion, an approach is presented that allows a tunable FSS structure 100 to have controllable variations in its mode of operation, its center frequency and/or its bandwidth.

Consider a bandpass filter with a frequency response consisting of a passband region and two transmission zeros (notch frequencies). The center frequency of the passband region is chosen to be between the two transmission zeros. Depending on the center frequency, as well as the positions of the transmission zeros, the overall response can have two different shapes. In a normal case where the transmission zeros and the center frequency are different, a bandpass response is specified where the bandwidth depends on the frequency separation between the two transmission zeros (passband region remains between the zeros or notches). In a sense, the difference between the two transmission zeros controls the bandwidth of the passband; the closer the zeros or notches, the narrower the bandwidth and vice-versa. In addition to the bandpass shape, this frequency response can have another shape. Instead of being different, if the transmission zeros overlap, the passband region disappears. In this case, the response becomes a single transmission zero or notch frequency. According to the exemplary embodiment in FIG. 7, tunable FSS structure 100 has a frequency response that includes first and second transmission zeros that are independently tunable such that the frequency response can be reconfigured or adjusted in terms of mode of operation (e.g., switch between bandpass and bandstop), center frequency and/or bandwidth.

The approach described above can be taken in constructing a multiple mode spatial filter; assuming the transmission zeros are independently tunable, the resulting frequency response can be switched between bandpass and bandstop modes. In the bandpass mode, by tuning the transmission zeros simultaneously, the frequency response can be swept such that the center frequency changes over a frequency range. Since the transmission zeros can be tuned independently, this frequency tuning approach also offers the opportunity to control the bandwidth independent of the center frequency. In the following, the synthesis of an exemplary frequency response is described.

Figure 7:
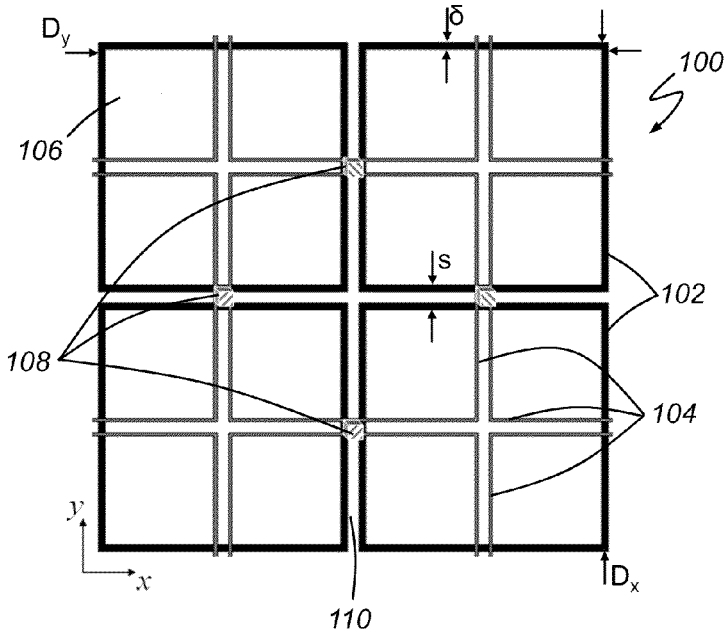
FIG. 7 is an illustration of several exemplary unit cells of a tunable FSS structure having loop arrays and a bias network.
Figure 8:
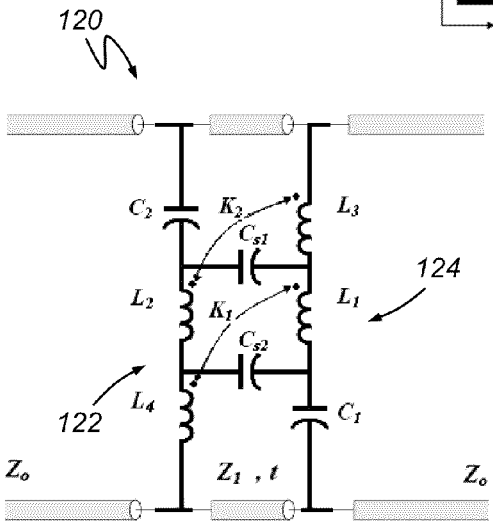
FIG. 8 is a schematic view of an equivalent circuit model for the exemplary tunable FSS structure of FIG. 7.

The tunable FSS structure 100 presented in this section includes two loop arrays 102, 104 that are located on opposing sides of a thin substrate 106 and constitute two parallel layers. Each loop array 102, 104 by itself may act as a bandstop spatial filter and produce a corresponding zero transmission or frequency notch. Given the reflective characteristic of the different loop arrays or layers, other coupling mechanisms may be needed to act in conjunction with the loop arrays 102, 104 in order to produce a bandpass frequency response. The electromagnetic coupling between the loop arrays or layers 102, 104 may be used to achieve a high-order frequency response that can improve the bandstop and/or bandpass characteristics of the tunable FSS structure 100. FIG. 7 shows four complete unit cells of loop array 102 on a front or top side of thin substrate 106, and one complete and eight partial unit cells of loop array 104 on a rear or bottom side of the thin substrate (loop arrays 102, 104 overlap one another and are located on opposing sides of thin substrate 106). The loop arrays or layers 102, 104 are translated or shifted laterally by half of a unit cell size with respect to each other in both orthogonal directions (ˆx,ˆy). To increase the influence of the electromagnetic coupling between the loop arrays 102, 104, a 0.127 mm (0.005 in) thick substrate 106 or laminate may be used for fabrication. For tuning purposes, each loop array 102, 104 may be loaded with one or more solid state varactor diodes 108 that connect loops of the same loop array in both ˆx and ˆy directions; i.e., an intra-layer, loop-to-loop connection. For modeling the operation of the exemplary tunable FSS structure 100, an equivalent circuit model 120 is shown in FIG. 8.

The equivalent circuit model for a single loop array is a series $L_i$ C circuit. The inductor in this model represents the inductance of the loop squares or traces, and the capacitor models the gap 110 between adjacent loops in the same loop array or FSS layer. Having two parallel loop arrays 102, 104, tunable FSS structure 100 essentially includes two series $L_i$ C branches 122, 124, each representing one of the two layers. A schematic of the circuit is provided in FIG. 8. As shown, the equivalent circuit model 120 has more elements than just two parallel series $L_i$ Cs branches 122, 124. This is due to the close proximity of the loop arrays or layers across thin substrate 106, which establishes electric and magnetic coupling mechanisms between them. The interaction between the loop arrays or layers (mixture of electric and magnetic) is represented by series junction capacitors (Cs1 and Cs2) and magnetic mutual couplings (K1 and K2). The series capacitors are expected to form at the crossing points between the two FSS layers. The magnetic coupling coefficients also represent the magnetic interaction of the conductive traces of opposite sides. The choice of the coupled pairs, as mentioned earlier, may be based on the lateral position of the layers, as well as the symmetry of the structure.

Figure 9:
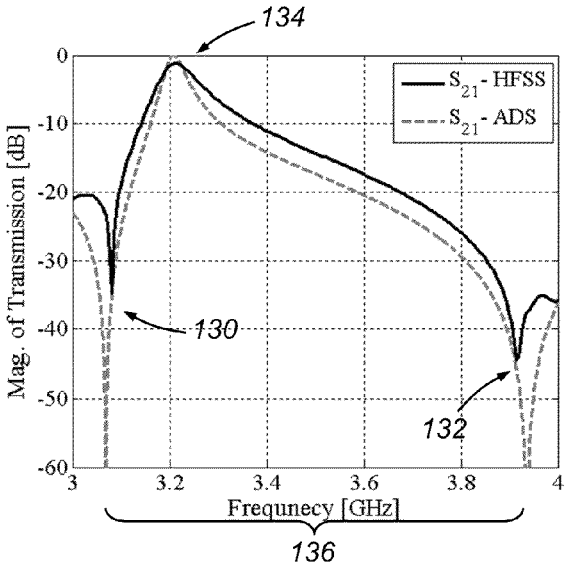
FIG. 9 is a graph comparing the frequency response of the actual exemplary tunable FSS structure of FIG. 7 with that of the equivalent circuit model of FIG. 8, where the tunable FSS structure is designed to act as a bandpass filter.

The following values have been assigned to elements of the equivalent circuit model 120 to test the expected frequency response, assuming the validity of the model. Circuit simulations using ADS exhibit a bandpass frequency response composed of two notches or transmission zeros 130, 132 on either side of a passband 134 generally having a bandwidth 136, as shown in FIG. 9. Next, to achieve operation at S-band, the full-wave simulations using Ansoft HFSS can be used to arrive at the geometrical parameters shown in Table. I.

TABLE I (Tunable FSS Structure Static Design Parameters at S-Band for Free-Space Operation)

| $s_1, s_2$ | $\delta_1$ | $\delta_2$ | t | $\epsilon_r$ | $D_x \times D_y$ |
|---|---|---|---|---|---|
| 0.45 mm | 0.125 mm | 0.275 mm | 0.125 mm | 2.2 | 10.5 mm × 10.5 mm |

In this table, δ denotes the width of the traces, s refers to the gap width between the loops, t is the substrate thickness, and (Dx,Dy) are the periodicity along ˆz and ˆy directions, respectively. Subscripts 1 and 2 are the indices of the layers. The design process also includes choosing appropriate capacitance values that are incorporated into the design as surface-mount capacitors interconnecting the loops. Using capacitors $C_1$=0.12 pF (layer 1) and $C_2$=0.4 pF (layer 2), full-wave and circuit simulations are performed. The tunable FSS structure 100 may generate a bandpass frequency response including two notches or transmission zeros 130, 132, which is well predicted by its circuit model, as demonstrated in FIG. 9. The exemplary values of the circuit elements are shown in Table. II. These values are the result of a curve-fitting process using ADS to get the best fit between the circuit response and the HFSS response.

TABLE II (Equivalent Circuit Model Values for Tunable FSS Structure at S-Band for Free-Space Operation)

| L1 | L2 | L3 | L4 | K1 | K2 | Cs1 | Cs2 | Ct1 (=Cg1 + C1) | Ct2 (=Cg2 + C2) |
|---|---|---|---|---|---|---|---|---|---|
| 10.26 nH | 5.37 nH | 0.97 nH | 0.51 nH | 0.13 | −0.93 | 10 fF | 27 fF | 0.139 pF | 0.413 pF |

Figure 10:
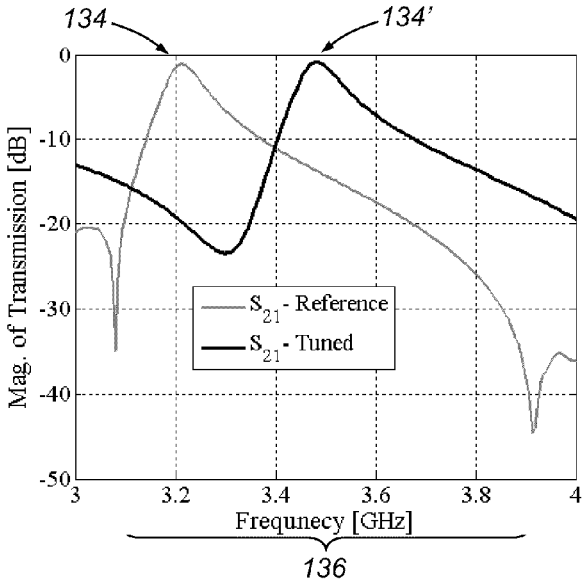
FIG. 10 is a graph illustrating how the exemplary tunable FSS structure of FIG. 7 can exhibit a frequency response where the center frequency changes.
Figure 11:
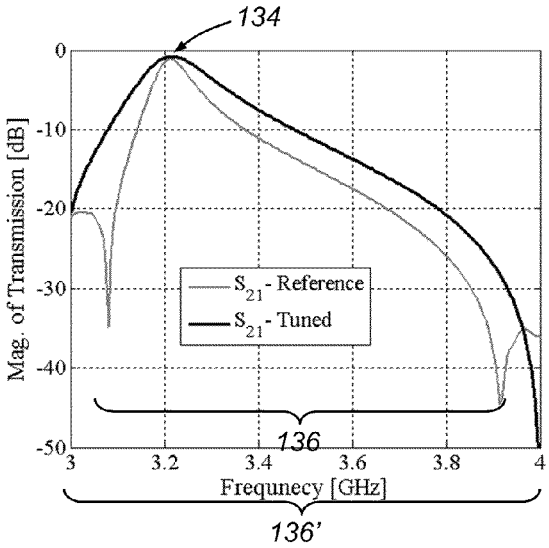
FIG. 11 is a graph illustrating how the exemplary tunable FSS structure of FIG. 7 can exhibit a frequency response where the bandwidth changes.
Figure 12:
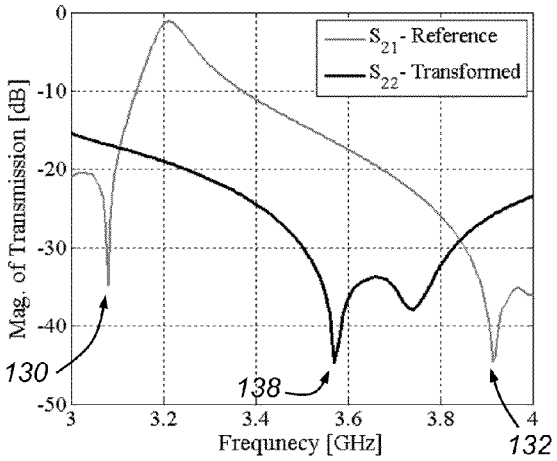
FIG. 12 is a graph illustrating how the exemplary tunable FSS structure of FIG. 7 can exhibit a frequency response where the mode of operation changes from a bandpass mode to a bandstop mode.

FIGS. 10-12 demonstrate some of the tuning or configuration features of tunable FSS structure 100 where, for purposes of illustration, the FSS structure has surfaces or layers with the exemplary parameters listed above and is loaded with different pairs of lumped capacitors. Capacitances for $C_1$ and $C_2$ can be changed or adjusted from some initial reference values (FIG. 9 illustrates the frequency response for such a set of initial values) to some other values in order to get a different frequency response. FIGS. 10-12 show three different frequency responses that may be achieved by varying or tuning the capacitances, as described. In FIG. 10, the center frequency of the passband 134' has been changed or shifted from its initial passband center frequency 134 while generally keeping the bandwidth 136 fixed (C1=0.2 pF and C2=0.1 pF may be used to achieve this). In FIG. 11, the bandwidth 136' has been changed (in this case increased) from its initial bandwidth 136 while generally keeping the center frequency 134 relatively fixed (C1=0.1 pF and C2=0.45 pF may be selected to achieve this). And in FIG. 12, the frequency response mode of operation of tunable FSS structure 100 has be changed or transformed from a bandpass filter having two transmission zeros or frequency notches 130, 132 to a bandstop filter having a single transmission zero 138 (C1=0.25 pF and C2=0.28 pF may be used to achieve this). Other changes and/or parameter values may be used instead, as the frequency responses shown in FIGS. 10-12 are only representative of some of the possibilities.

Although the description above refers to specific exemplary frequency responses, almost any desired frequency response (in terms of mode of operation, center frequency and bandwidth) may be achieved by appropriately choosing the values of the capacitors (C1,C2) and other parameters of tunable FSS structure 100. A potentially important practical issue here is the capacitance range that can be achieved by using one or more varactor diodes 108, which is a specialized diode that is capable of changing its level of capacitance depending on the level of reverse bias applied to the diode; also known as a varicap diode. The design presented here takes into account this issue by manipulating other design parameters so that a practical range from 0.1 to 1 pF is sufficient to produce most desired frequency responses; this way, a desired frequency response may be achieved by simply adjusting the properties of the varactors. As previously mentioned, tunable Barium Strontium Titanate (BST) capacitors are tunable with a bias voltage and may be used in lieu of or in addition to varactor diodes. Varactor diodes, BST capacitors and all other suitable components that have an adjustable or controllable capacitance are collectively referred to herein as "varactors." It is also possible to manipulate the frequency response by altering the geometric parameters of the tunable FSS structure 100 (e.g., adjusting the dimensions of the loops and gaps). According to one embodiment, tunable FSS structure 100 is designed to operate between 3-4 GHz and is fabricated through standard etching of copper on a 0.127 mm (0.005 in) thick Taconic TLY5 substrate, however, other frequency ranges, fabrication techniques and/or substrates may be used. The bias voltage may be adjusted or controlled by applying it between two corners of tunable FSS structure 100, for example, such that the loop traces act as the bias wires.

Figure 13:
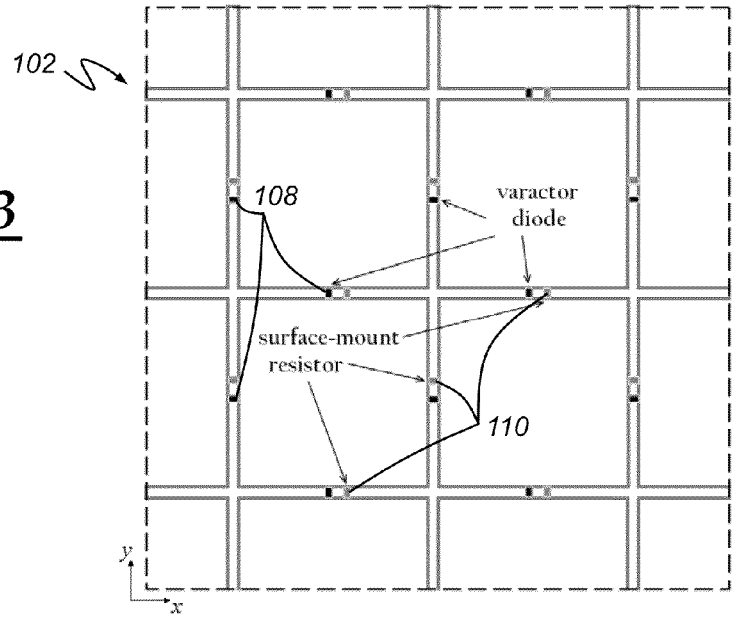
FIG. 13 is an illustration of several exemplary unit cells from one of the loop arrays of the tunable FSS structure of FIG. 7, where several components of a bias network are shown.

The construction of a biasing network for exemplary tunable FSS structure 100 for operation in a free-space environment is discussed below, where the structure includes one or more varactor diodes. Unlike a waveguide measurement environment, for example, a tunability test in a free-space environment is rather easy and can use a simple resistive bias network. A portion of exemplary loop array 102 is shown in FIG. 13 loaded with a number of varactor diodes 108 and biasing resistors 110 that help form a bias network. The bias network uses the conductive loops as its circuitry, and therefore, no additional traces are needed. Surface-mount biasing resistors 110 with proper ohmic values are placed in parallel with each varactor 108 and connect adjacent loops within loop array 102 together. A regulated DC voltage source may then be connected to the loop in the top-left corner of loop array 102, for example, while the loop sitting in the opposite side (bottom-right corner of loop array 102) is grounded. To avoid disturbing RF operation of tunable FSS structure 100, RF chokes may be used to make connections between the FSS and source/ground. The bias resistance is preferably chosen to be much smaller than the impedance of a reverse-biased varactor diode in DC (e.g., $\approx 10^{15}$). This way, the voltage across the varactor 108 is determined by the current flowing in the resistor 110 in DC. As a result, a known DC voltage is established for appropriately biasing the varactor diode 108. The bias resistance, on the other hand, should be large enough so that the ohmic loss of the resistor at high frequencies will be well below the varactor loss. For this design, MA46H120 flip-chip GaAs varactors by M/A-COM may be used. An MA46H120 varactor has a Q-factor of ≈100 at 3 GHz. A lossy varactor can be modeled as a lossless capacitor in parallel with a resistor. Given a Q-factor of 100, the parallel resistance (Q/wC) becomes on the order of $10^{15}\Omega$. With this calculation, an appropriate bias resistance could be $\approx 10^7\Omega$, for example. Of course, other varactors, resistors and/or arrangements may be used instead, as this is only one possible embodiment.

As mentioned above, available varactors are sometimes limited by their Q-factors at high frequencies. It is possible that varactors used to build the tunable FSS structure 100, as a result, may contribute to a lower performance of the FSS structure. With a Q-factor of ≈150, this loss could be about 1 dB.

A tunable or reconfigurable FSS structure 100 based on sub-wavelength miniaturized elements (metamaterials) is described above. It is shown that the frequency response of tunable FSS structure 100 can be modified or adjusted using varactor diodes 108 or lumped capacitances incorporated into the surfaces of the structure. This feature provides for a fully tunable bandpass and/or bandstop frequency response. Through numerical simulations, it is demonstrated that one can easily tune either the center frequency with a fixed bandwidth or tune the bandwidth while keeping the center frequency fixed. It is also shown that the frequency response mode of operation can be transformed from bandpass to bandstop by controlling the biasing of the varactor diodes.

Tunable Frequency-Selective Surface (FSS) Structure without Bias Network

The ability to electronically tune or alter the frequency response can be a practical feature in the design of spatial filters. Generating a dynamic frequency behavior may require that the reactive characteristics of a FSS structure change with a tuning voltage or current. An exemplary tunable frequency selective surface (FSS) structure 150 is described below with an embedded bias network, where the structure may function as a bandpass filter. In this particular embodiment, one or more varactor diodes may be biased in parallel and thus controlled individually without the need for a separate bias network. This arrangement can make tunable FSS structure 150 immune or more resistant to a single point failure.

Figure 14:
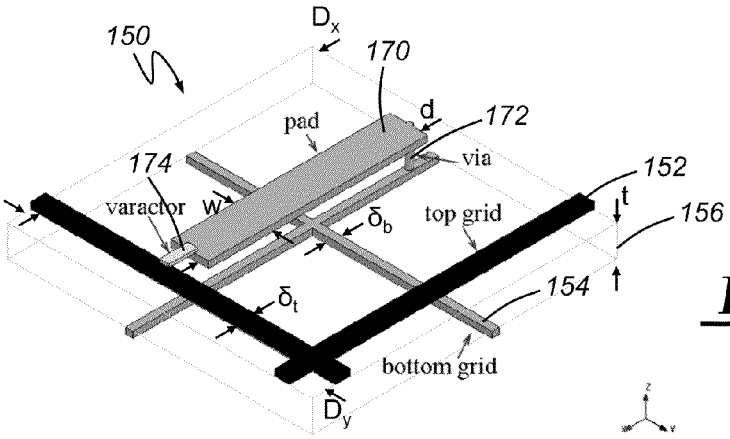
FIG. 14 is an illustration of several exemplary unit cells of a tunable FSS structure having conductive grids and no bias network.

The tunable FSS structure 150 resembles a two-sided circuit-board that includes two conductive grids 152, 154 located on opposite sides of a thin substrate 156. An exemplary illustration of several unit cells for tunable FSS structure 150 is shown in FIG. 14. As illustrated, the conductive or wire grids 152, 154 can be laterally shifted with respect to one another by half of the unit cell size in both ˆx and ˆy directions. In this way, the corner of a square cell of the upper conductive grid 152 lines up with the center of a square cell of the lower conductive grid 154, and vice-versa. According to an exemplary embodiment, a small pad or horizontal link 170 is located inside of the conductive grid 152 and is connected at one end to conductive grid 152 (top grid) via a varactor diode 174, and is connected at the other end to conductive grid 154 (bottom grid) via a vertical link or post 172. The vertical link 172 may be a metalized post or connection that extends through the thickness of substrate 156. The varactor diode 174, top conductive grid 152, horizontal link 170, vertical link 172, and bottom conductive grid 154 are all electrically connected to one another and constitute an electrical circuit that may be used in the biasing of the various elements.

Figure 15:
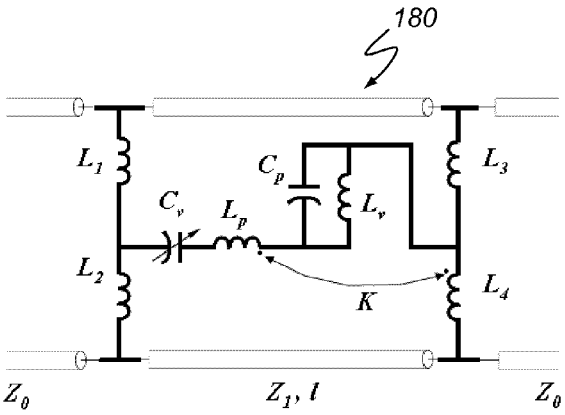
FIG. 15 is a schematic view of an equivalent circuit model for the exemplary tunable FSS structure of FIG. 14.

The bandpass characteristic of tunable FSS structure 150 can be described using circuit theory: the conductive grids 152, 154 are inductive which together with the varactor create a circuit topology similar to that of the Wheatstone bridge. An equivalent circuit model 180 of tunable FSS structure 150 is shown in FIG. 15. In this exemplary model, inductors $L_1$ and $L_2$ represent the metallic traces of the top conductive grid 152, and $L_3$ and $L_4$ model the traces of the bottom conductive grid 154. The varactor diode 174 is shown by $C_v$ in the circuit. The horizontal link or connection 170 can behave like a small piece of transmission line which is modeled by inductor $L_p$ and capacitor $C_p$. Other elements of equivalent circuit model 180 are the inductor $L_v$ representing the vertical link or post 172 and the mutual inductance K. This mutual electromagnetic coupling is created as horizontal link 170 and the bottom conductive grid 154 are overlaid on one another. Given this arrangement of inductors and capacitors, a bandpass frequency response may be produced if the bridge is unbalanced, which happens when the ratio of the two inductors connected to the left terminal ($L_1$ and $L_2$) differs from that of the two inductors connected to the right terminal ($L_3$ and $L_4$).

As described above, all of the varactors 174 are connected to conductive grid 152 at one terminal and are connected to conductive grid 154 at the other terminal via horizontal and vertical links 170, 172. Hence, by applying a DC voltage between the two conductive grids 152, 154, all of the varactor diodes 174 may be biased at the same voltage (parallel biasing). Obviously, the conductive grids 152, 154 are functioning simultaneously as the elements of the tunable FSS structure and the bias network.

This section outlines the FSS design procedure for deploying full-wave and circuit simulators. The design goals may include: 1) achieving a small unit cell dimension (e.g., ≈λ/10) in order to obtain a better uniformity and thus less sensitivity to the incidence angle of the electromagnetic signals being filtered; and 2) achieving a reasonably large tuning range while keeping the capacitance variations within a practical range (0.1-1 pF).

As mentioned earlier, ADS analysis of the equivalent circuit model 180 reveals that a bandpass mode or frequency response can be produced by tunable FSS structure 150 provided that the bridge is unbalanced. This requirement can be accomplished in practice by positioning the vertical link or post 172 so that the unit cell is asymmetrical (unbalanced). An example of an exemplary unit cell is shown in FIG. 14. After finding an appropriate place for the vertical link 172, other design parameters may be optimized to further improve the bandpass or other frequency response characteristics of the tunable FSS structure 150. The simulations use the periodic boundary conditions (PBC) in Ansoft HFSS. This setup simulates a large array of unit cells on an FSS structure that are exposed to a plane-wave incident at an arbitrary angle. The following simulations assume a plane-wave polarized parallel to the horizontal link or pad 170. The effects associated with the dielectric/copper loss and a finite Q-factor of the varactor 174 are also included.

For operation at X-band, a unit cell size ($D_x$,$D_y$) of 4.8 mm may be chosen to attain the aforementioned design goals. With such periodicity, the initial values assigned to the width of the conductive grids ($\delta_t$ for top conductive grid 152 and $\delta_b$ for bottom conductive grid 154) may become 0.1 mm which is well above the minimum feature size (≈0.05 mm) that can be reasonably fabricated using standard copper etching processes. The optimization is then focused on other parameters of the design including w representing the width of the pad or horizontal link 170, d as the length of the pad or horizontal link, and t representing the thickness of thin substrate 156 (see FIG. 14). The thin substrate may be made from any suitable material, including Rogers RT/duroid 5870 material, with a 1=2 Oz. copper cladding. Table III provides some exemplary optimized values for the parameters.

TABLE III (Tunable FSS Structure Static Design Parameters at X-Band for Free Space Operation)

| $\delta_1$ | $\delta_2$ | w | t | d | $\epsilon_r$ | $D_x \times D_y$ |
|---|---|---|---|---|---|---|
| 0.24 mm | 0.12 mm | 0.5 mm | 0.4 mm | 3.73 mm | 2.2 | 4.8 mm × 4.8 mm |

Figure 16:
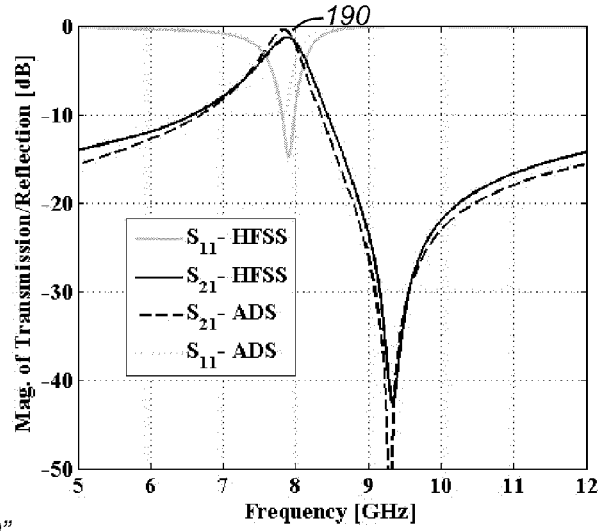
FIG. 16 is a graph comparing the frequency response of the actual exemplary tunable FSS structure of FIG. 14 with that of the equivalent circuit model of FIG. 15.

Given these values, the frequency response of tunable FSS structure 150 was calculated using HFSS. The simulated results compared to those obtained by ADS are given in FIG. 16, showing a good agreement between the FSS and its equivalent circuit model 180. The circuit model values are shown in Table IV. These values are the result of a curvefitting process using ADS to get the best fit between the circuit response and the HFSS response.

TABLE IV (Circuit Model Values for Tunable FSS Structure at X-Band for Free-Space Operation)

| $L_1$ | $L_2$ | $L_3$ | $L_4$ | $L_p$ | $L_v$ | K | $C_p$ | l |
|---|---|---|---|---|---|---|---|---|
| 0.35 nH | 1.73 nH | 1.45 nH | 0.17 nH | 0.37 | 0.04 | 1 | ≈0 (10 fF) | 5° |

Figure 17:
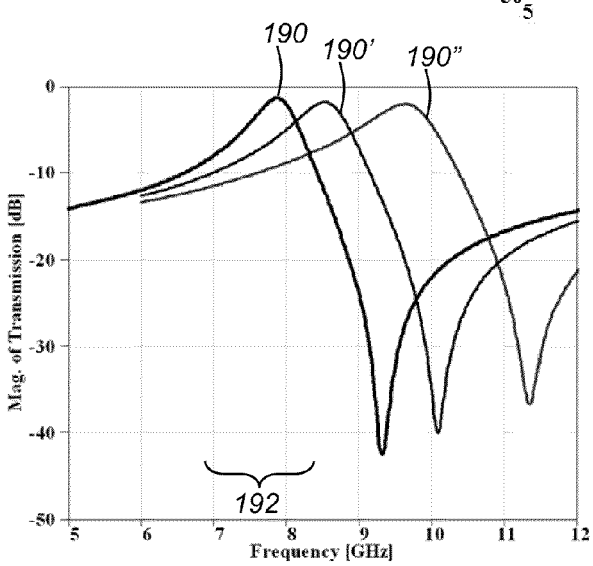
FIG. 17 is a graph illustrating how the exemplary tunable FSS structure of FIG. 14 can exhibit a frequency response where the center frequency changes.
Figure 18:
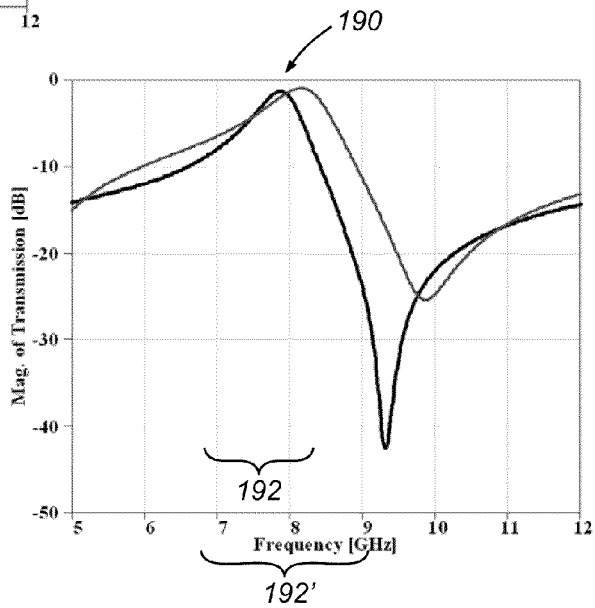
FIG. 18 is a graph illustrating how the exemplary tunable FSS structure of FIG. 14 can exhibit a frequency response where the bandwidth changes.

FIGS. 17 and 18 show two different frequency responses that may be achieved by varying or tuning the capacitances, as described. In FIG. 17, the center frequency of the passband is changed or swept from an initial center frequency 190 of about 8 GHz through a new center frequency 190" of about 11.5 GHz while generally keeping the bandwidth 192 fixed (Cv=1, 0.3 and 0.1 pF and Qc=25 may be used to achieve this). In FIG. 18, the bandwidth 192' has been changed (in this case increased) from its initial bandwidth 192 while generally keeping the center frequency 190 relatively unchanged. Other changes and/or parameter values may be used instead, as the frequency responses shown in FIGS. 17-18 are only representative of some of the possibilities. The FSS structure preserves its frequency-selective characteristic; however a lower selectivity may be observed while scanning at a 45° angle.

A tunable frequency-selective surface (FSS) structure 150 with sub-wavelength periodicity is shown in the drawings and described above. The tenability may be achieved by using, among other things, a varactor diode 174/horizontal link 170/vertical link 172 to connect top and bottom conductive grids 152, 154 and to bias the varactors in parallel without any external biasing circuitry. This new architecture may include two conductive grids or layers 152, 154 along with a horizontal and vertical links or connections 170, 172 built on a thin substrate 156. This tunable FSS structure may allow for implementation of large-scale tunable surfaces with high performance.

Antenna Array with Frequency-Selective Surface (FSS) Structure

Research on multilayer, dielectric superstrates in the past was primarily concerned with antenna gain or bandwidth enhancement. A stack of electric and magnetic superstrate layers, if arranged and chosen properly, can behave like a lens for an antenna. Once placed on top of an antenna, this stack of substrates may generally bend the electromagnetic rays emanating from and incident upon the antenna according to Snell's law. A transmission line modeling of the multiple layers can be used to choose the layer parameters in order to achieve the highest gain.

Periodic structures (e.g., electromagnetic photonic bandgap (EBG) or frequency selective surface (FSS)) may be utilized as a superstrate layer in antenna applications to increase the gain and/or to enhance the bandwidth. Superstrates may include dielectric layers and/or layouts that are placed above one or more radiating elements of an antenna. Practically speaking, some superstrates can have an adverse effect on the scan performance of an antenna, an undesirable feature particularly in scanned-array designs. Also, some superstrates can increase the overall height or thickness of the antenna; this is particularly true for conventional arrangements that require a separation distance of $\lambda/2$ or more between the antenna and the superstrate. This thickness might not be practical for some applications. Moreover, the thickness of the superstrate itself can be another limiting issue. The exemplary antenna arrangement described below includes a thin FSS structure or layer positioned over top of an antenna element which can make it preferable for certain antenna applications, such as beamforming antenna arrays.

Digital beamforming (DBF) is a powerful method that may be used to enhance antenna performance, where the received signal from each array element is processed individually. However, a potential drawback of the DBF approach is the cost of vertical integration; i.e., each element of the beamformer requires its own transceiver chain consisting of an amplifier, filter, mixer, etc. In addition, the current silicon technology may not be capable of integrating all the components required in the transceiver chain on a single chip. For instance, some of the microwave filters available to engineers are bulky and take up a large volume. When used in a beamformer, such filters may require a minimum limit (possibly larger than $\lambda/2$) on the spacing between the array elements. As a result, the grating lobes could become inevitable.

Figure 19:
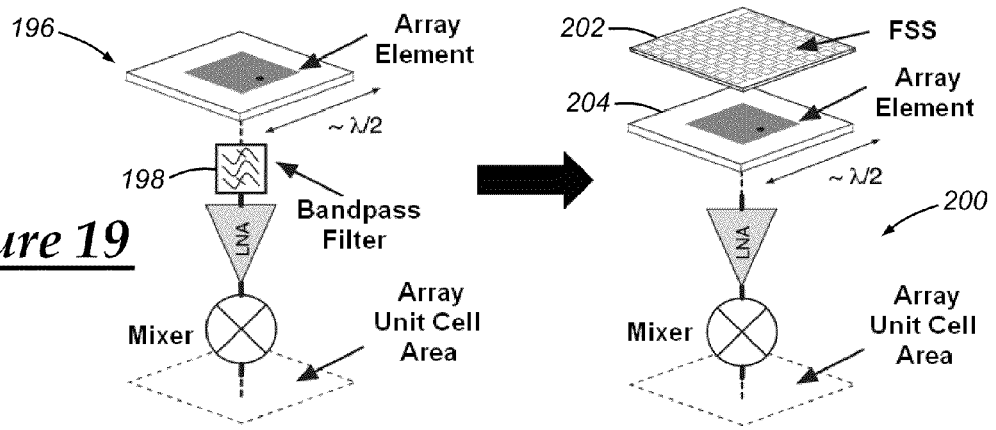
FIG. 19 is a schematic illustration of the transceiver path in a conventional beamforming antenna array compared to the transceiver path of an exemplary antenna arrangement having a frequency-selective surface (FSS) structure laid over an antenna array.

In the exemplary antenna arrangement shown and described herein, the bandpass filters in the transceiver chain can be eliminated; instead, a thin FSS structure or layer 202 is laid over or placed on top of an antenna array 204 as a thin superstrate layer that performs the required filtering. This arrangement is schematically shown in FIG. 19, where a conventional antenna arrangement 196 has a transceiver path which includes a separate filter 198 in the transceiver path of each element of the antenna arrangement. In the exemplary embodiment, this separate filter is replaced with a thin FSS structure or layer 202 that is located over top of an antenna array 204. As a result, a single FSS structure 202, instead of one filter per element, can perform the filtering for a whole array of antenna elements. In addition to addressing certain fabrication issues, this embodiment may also be able to reduce the overall cost as a single FSS structure 202 can replace the numerous bandpass filters required in the conventional antenna arrangement 196. An exemplary antenna arrangement 200 with a thin FSS structure or layer 202 that is based on a sub-wavelength miniaturized element FSS is describe here. This antenna arrangement—which has a low thickness (e.g., ~$\lambda/10$)—may be used in a reduced beamforming array or some other antenna application, where the bulky bandpass filters in the transceiver chain of each antenna element have been eliminated. The necessary filtering can then be performed by the FSS structure 202 that is placed over the antenna array 204 (see FIG. 19) at a distance of about $\lambda/10$.

The following analysis assumes an infinitely large array of antenna elements and therefore does not account for the potential effects associated with a finite size array. These effects may include, for example, the array edge diffraction and the different, non-uniform mutual coupling between the elements of the finite array compared to the infinite case, as is appreciated by those skilled in the art.

A variety of different FSS structures may be used with an antenna as a filtering layer in the manner described herein, including the exemplary FSS structure 202 which is a two-dimensional periodic structure and has a loop array 210 and a conductive grid 212 on opposite sides of a thin substrate 214. According to one exemplary embodiment, FSS structure 202 has a periodicity of 3.39 mm for operation at X-band and includes a loop array 210 with traces having a width of about 0.11 mm and a gap between loops being 0.11 mm, a conductive grid 212 with traces being 0.95 mm thick, and a thin substrate 216 with a dielectric constant of $\in_r=2.94$ and a thickness of 0.1 mm. This particular FSS structure has no lumped capacitors in its structure.

Figure 20:
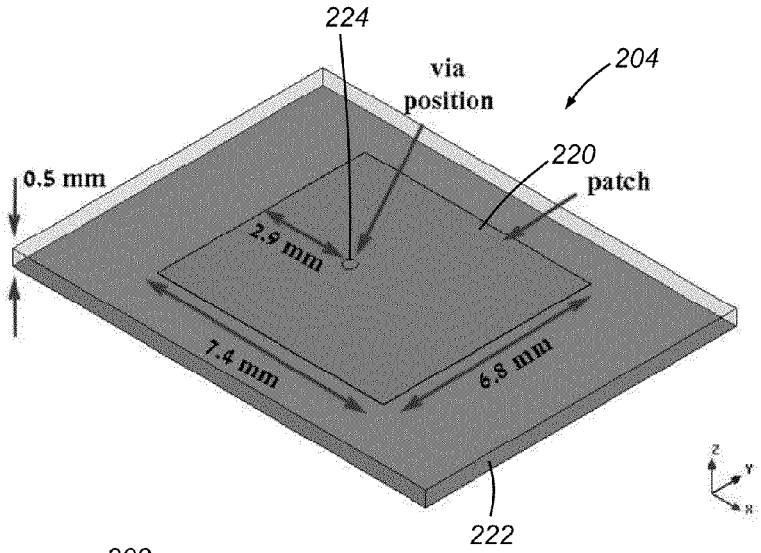
FIG. 20 is a schematic illustration of an exemplary unit cell of a patch-type antenna array.

The FSS structure 202 described herein may be used with any number of different antenna elements, antenna arrays and/or other antenna applications. One exemplary application that may be able to utilize the present FSS structure is a microstrip patch antenna, such as the exemplary microstrip patch antenna array 204 illustrated in FIG. 20 (only one unit cell of antenna array 204 is shown in FIG. 20 but, as explained above, it is assumed that the array has an infinite number of elements). This exemplary unit cell includes a patch 220 placed on one side of a dielectric substrate 222. The patch 220 can be fed or connected through a metalized, vertical post 224 (e.g., probe-fed) from the back side of substrate 222 which can have a dielectric constant of 3.38 and can be 0.5 mm thick, for example. An entire antenna array with a number of patches can be designed to work at a particular center frequency. In order for an antenna array to work at the exemplary center frequency of 10.5 GHz, for example, the dimensions of patch 220 may need to be 7.4 mm×6.8 mm. Other dimensions are provided in FIG. 20 which shows a single element or unit cell of the infinite antenna array. Again, the FSS structure 202 described herein is not limited to this particular antenna application or to these specific parameters, as they are only representative of one of the many types of antennas that could utilize the FSS structure.

Figure 21:
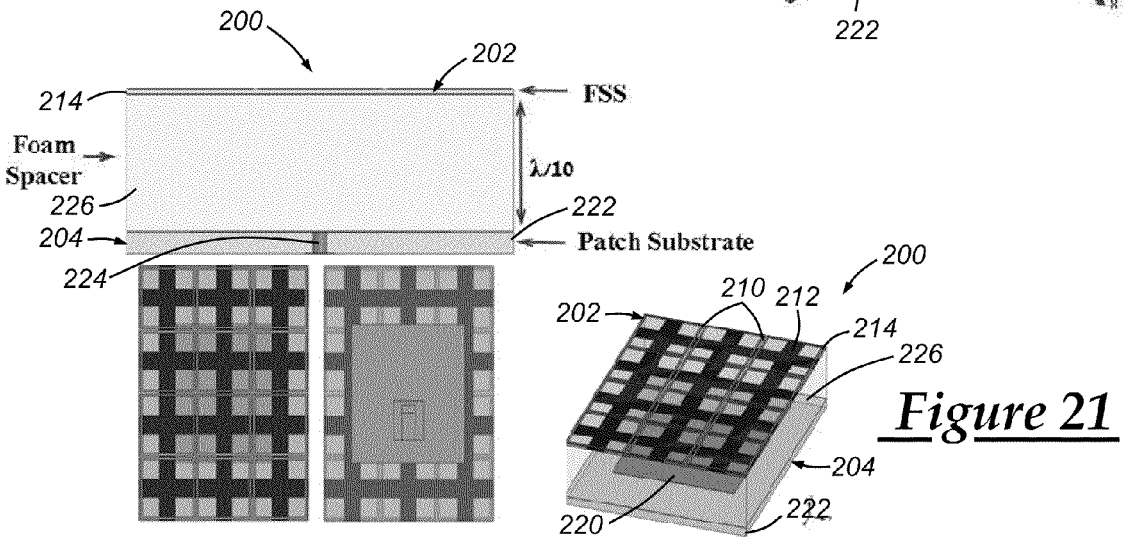
FIG. 21 is a schematic illustration of an exemplary antenna arrangement having a FSS structure laid overtop of an antenna array.

The microstrip patch antenna array 204 described above may be used to construct a two-dimensional, infinite antenna array on x ; y plane for numerical simulation. The periodicity of the antenna array along the ˆx and the ˆy directions may be smaller than λ/2 in order to avoid the grating lobes, although this is not necessary. A unit cell of an exemplary antenna array is shown in FIG. 21 with a section of FSS structure 202 placed or otherwise located over top of it. This unit cell can be simulated using a PBC setup in HFSS to test the radiation characteristics of the array. As mentioned previously, this simulation assumes an infinite number of such unit cells in the array.

The results of full-wave simulations are presented in this section. In the first set of simulations, the exemplary two-dimensional antenna array 204 with microstrip patch elements is used. The simulated fields for the infinite problem are then used to approximately calculate a finite antenna array (e.g., a 9×9 array). These calculations are performed in HFSS simply by calculating the array factor (AF) and multiplying that with the fields (from the infinite array simulation). Next, similar simulations can be performed for the same antenna array, but this time it is covered with exemplary FSS structure 202. A thin dielectric spacer 226 may be placed between FSS structure or layer 202 and antenna array 204 such that the overall antenna arrangement (i.e., the antenna array and FSS structure combination) is only λ/10 thicker than the original antenna array of patches.

Figure 22:
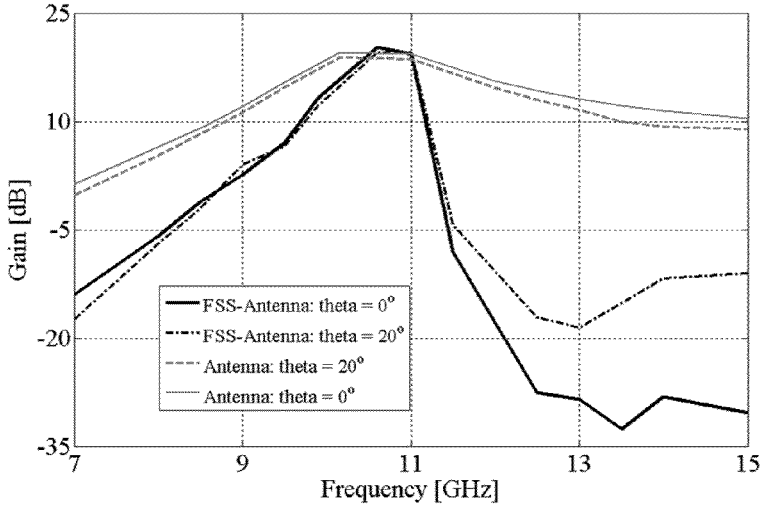
FIGS. 22-27 are graphs illustrating different characteristics of the exemplary antenna arrangement of FIG. 21 with and without the FSS structure.

As mentioned above, frequency filtering is one of the main tasks of antenna arrangement 200 with its FSS structure or layer 202. The simulated frequency responses for the antenna array 204 with and without FSS layer 202 are shown in FIG. 22. For these particular graphs, the simulations were performed for scan angles of 0° and 20°. As shown, the antenna array 204 radiates and receives electromagnetic signals with a much higher selectivity when FSS layer 202 is used. In a way, antenna arrangement 200 has a bandpass filter embedded in its receive/transmit path, and does so by placing a very thin FSS structure or superstrate over top of an antenna array.

Comparison between the simulations of the frequency responses also shows an improvement in the out-of-band-rejection ranging from 20 dB (at the lower band frequencies) to 40 dB (at the upper band frequencies), and an improvement in the frequency roll-off rate which is much steeper at the upper band as it changes from −5 dB/GHz to −40 dB/GHz, for example. The antenna arrangement including both the FSS structure 202 and antenna array 204, in addition, has an extremely low thickness that makes it suitable for a number of different antenna applications.

Figure 23:
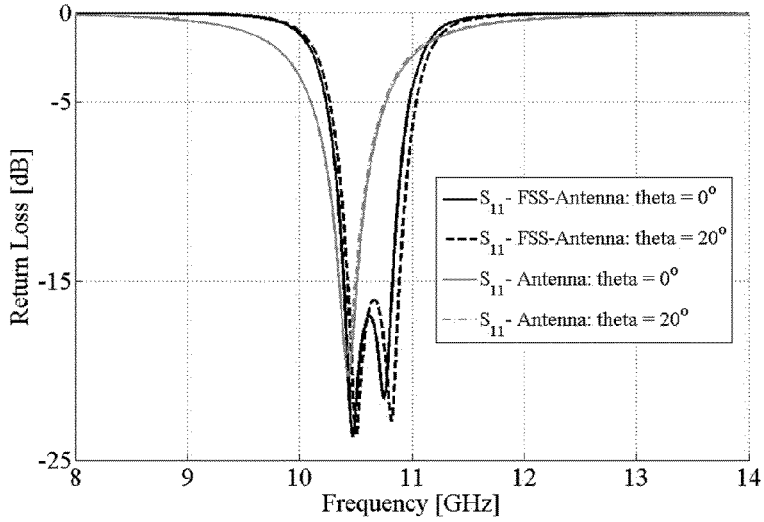

Next, some other aspects of the antenna arrangement 200 are examined. The simulated return loss for the antenna array 204 with and without the FSS structure 202, for scanning at 0° and 20°, is shown in FIG. 23. According to the simulations, the antenna array with the FSS layer produces a two-pole, maximally flat frequency response. This phenomenon (extra pole) is attributed to the coupling of the FSS elements and the patches as FSS structure 202 and antenna array 204 are very close to one another. This two-pole behavior may allow for shaping the frequency response of the antenna; in addition to tuning the bandwidth, this effect may be employed to achieve sharper edges (steeper roll-off) around the frequency band of operation, etc. As a secondary feature, the dual-pole behavior enables the designer to create a wider band of operation. In the example model considered here, a factor of 2.5 increase in the bandwidth compared with the array antenna in isolation is observed. As shown in the exemplary bandstop filter of FIG. 23, the operation band of the antenna is increased from 10.4-10.6 GHz to 10.4-10.9 GHz.

Figure 24:
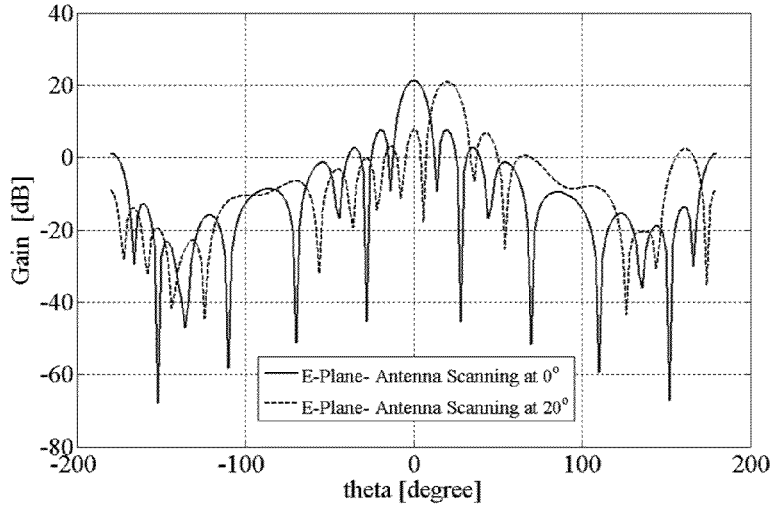
Figure 25:
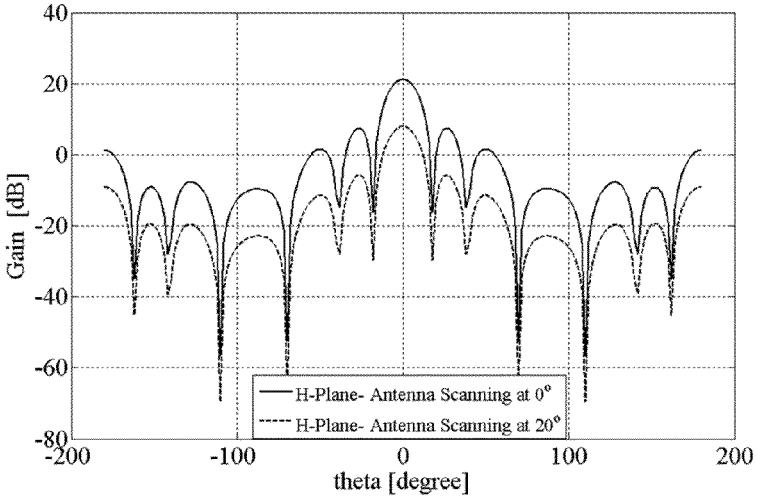
Figure 26:
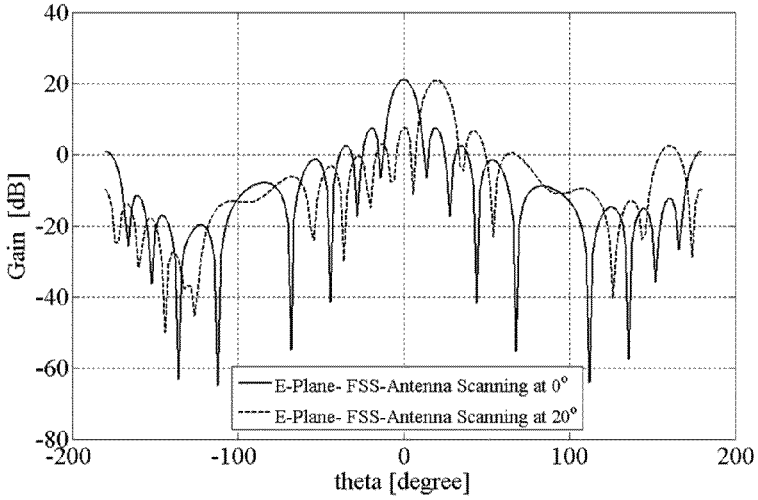
Figure 27:
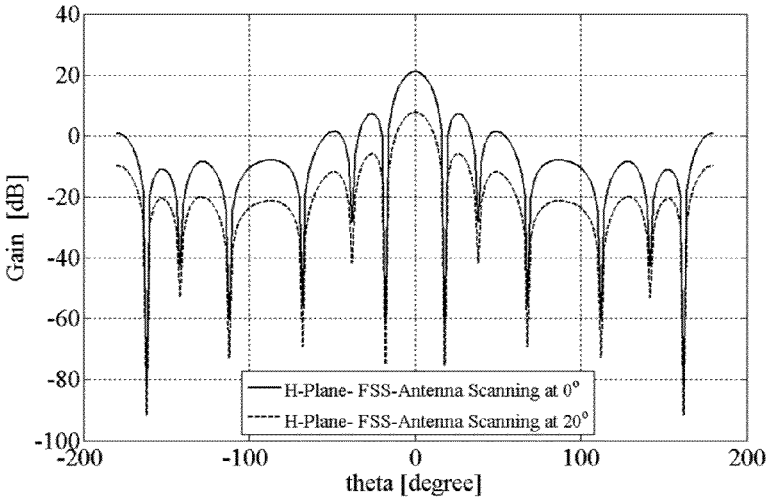

Other antenna parameters can be calculated and compared. The radiation pattern cuts of the 9×9-element patch-array are shown in FIG. 24 (E-plane) and FIG. 25 (H-plane) at an exemplary resonance frequency (10.46 GHz), where the exemplary antenna array 204 is not covered with an FSS layer. As shown, the antenna peak-gain is slightly more than 20 dB and shows no sensitivity to scanning (at least up to 20°). The calculated pattern for the same 9×9-element patch-array with the exemplary FSS layer 202, on the other hand, is shown in FIGS. 26 and 27. As can be seen, the radiation patterns for the combined antenna and FSS layer are very similar to those of just the antenna.

Based on these simulation results, the combined antenna arrangement 200 generally behaves like a filter added to the antenna array without affecting the gain, scan performance, and the polarization response of the antenna array, and also provides an opportunity to enhances the bandwidth of the antenna array. The miniaturized element FSS structure 202 may be an X-band, 6 in×6 in thin FSS, such as any one of the FSS structures described above. The FSS structure or layer 202 may be fabricated through standard etching of copper on a 0.004 in thick CLTE substrate by Arlon, for example. This substrate which is a PTFE composite material can have a nominal dielectric constant of 2.94. The measured transmissivity of the surface is provided in FIG. 28 for different scan angles up to 25°. As stated before, all numbers, values, parameters, etc. provided herein are merely exemplary and intended for purposes of illustration.

Figure 30:
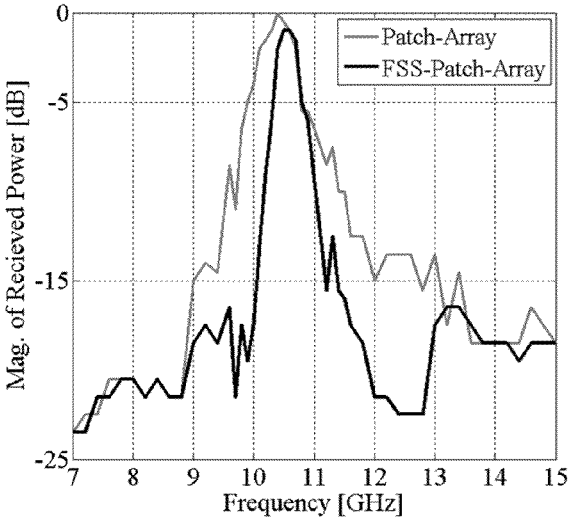
FIG. 30 is a graph illustrating the received power by a patch of the exemplary antenna array of FIG. 21 with and without the FSS structure.

The fabricated antenna array 204 can be a 9×9-element array of probe-(pin-)fed, rectangular patch antennas built on a 0.5 mm-thick RO4003C substrate with the dielectric constant of 3.38. As discussed above, each element of a beam-forming array has a separate feed network or transceiver chain. As a result, the filtering effects of the FSS structure 202 should be observed at the terminal of the individual element. To emulate a similar condition in the measurement, the antenna array is fabricated with independently-fed elements; i.e., no corporate feed network is used. Each patch 220 can be fed by a pin connected to the patch at a point where the input impedance is 50Ω at 10.4 GHz, for example. Here, only the received power as a function of frequency by the patch located at the center of the array is presented. To do this, the center patch is connected to an SMA connector for power reading, and the surrounding patches are matched to 50Ω through surface-mount resistors, each of which connecting the pin of an off-center patch to the ground-plane. This way, antenna array 204 is built to work in the receive mode. Given the receive mode measurement results, the transmission characteristics of the array are also known according to the reciprocity theorem. FIG. 30 demonstrates an exemplary antenna arrangement 200 with a microstrip patch antenna array 204, a foam spacer 226, and a loop/wire FSS structure or layer 202 placed over the antenna array.

As mentioned earlier, the miniaturized elements of FSS structure 202 can perform properly in a close proximity of radiating elements. This allows placement of the FSS structure or layer 202 near the antenna array 204, thus enabling mutual electromagnetic coupling between the antenna and the FSS resonators. Coupling two resonators, one can achieve a maximally flat or dual-band response, as explained above. In this design, the FSS structure 202 can be placed at a distance of λ/10 to the patch-array to establish a proper electromagnetic coupling between the patch and the loops 210 and conductive wire grid 212 of the FSS structure. As will be shown below, because of the coupling, the selectivity of the FSS-antenna combination becomes better than the antenna array or the FSS structure alone.

Figure 29:
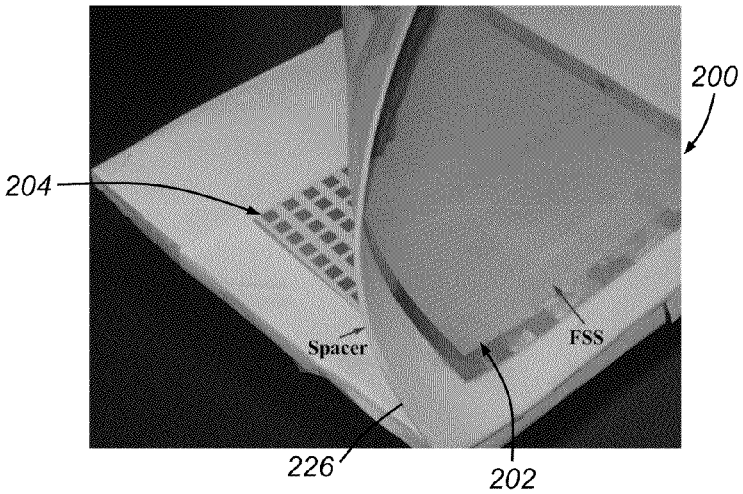
FIG. 29 is a photograph of a portion of the exemplary antenna arrangement of FIG. 21, with the FSS structure or layer somewhat peeled back to reveal the underlying antenna array.

Finally, to assemble exemplary antenna arrangement 200, a λ/300-thick FSS structure or layer 202 can be overlaid on top of the patch-type antenna array 204, as demonstrated in FIG. 29. The FSS structure and the antenna array may be separated by a thin dielectric spacer 226, such as a λ/10-thick PF-2 foam ($_r$=1.03) by Cumming Microwave, Avon, Mass. The setup for measuring the receiving characteristics of the antenna array may include a transmitter (horn antenna) placed at one end of an anechoic chamber and the array itself located at the opposite side of the chamber. The center patch of the array is the receiver and is connected to a spectrum analyzer for power reading. The received power at multiple frequency points covering the band 7-15 GHz is manually collected for two cases: 1) patch-type antenna array 204 alone, and 2) patch-type antenna array 204 with FSS structure 202.

The measured, received power by the center patch as functions of frequency for the two cases mentioned above at normal incidence are shown in FIG. 30. Scan performance comparison is provided in FIG. 31 for scanning at 0°, 15°, and 30°.

Figure 28:
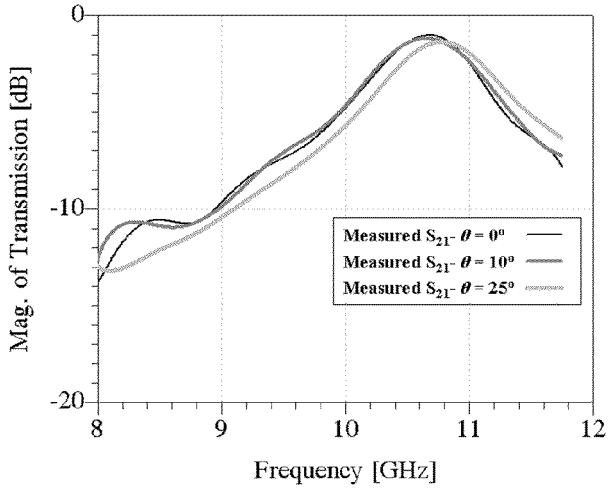
FIG. 28 is a graph illustrating the measured transmission response of the exemplary antenna arrangement of FIG. 21 at different angles of incidence.
Figure 31:
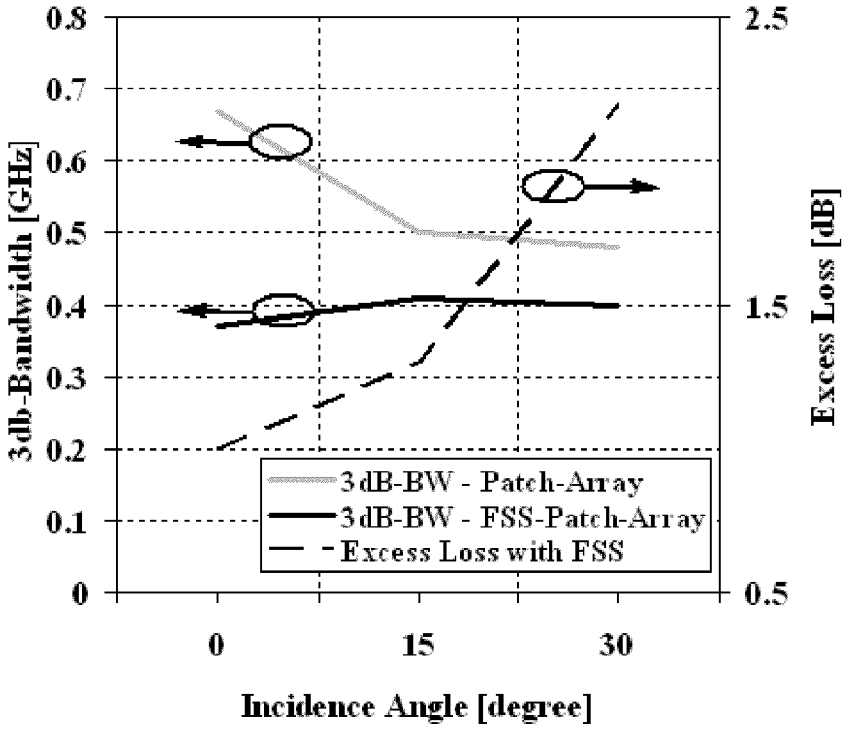
FIG. 31 is a graph comparing the 3-dB bandwidth and excess loss as a function of angle with and without the FSS structure.

The received power by the antenna arrangement 200 (combination of FSS structure 202 and antenna array 204), compared with the antenna array alone, exhibit the filtering effect of the FSS; in the power response (FIG. 30), the bandwidth becomes half and the frequency roll-off rate increases by almost a factor of two around the center frequency (10.6 GHz). Moreover, the received power shows a maximally-flat characteristic, mentioned in Section V-C3, around the center frequency, a dual-pole behavior due to the coupling of the elements 210, 212 of the FSS structure with the patches 220 of the antenna array. Resulting from the close proximity of the FSS structure 202 and the patches 220 (e.g., λ/10), this electromagnetic coupling improves the frequency selectivity of the antenna arrangement 200. However, the transmission loss may be increased by about 1.5 dB, as shown in FIG. 28, the insertion loss of the FSS structure itself is about 1.2 dB, which can increase the insertion loss (1.5 dB) of the antenna arrangement. The excess insertion loss of 0.3 dB in the response of the combined FSS-antenna can be attributed to the mismatch occurring at the FSS-dielectric spacer interface. The 3-dB bandwidth of the FSS structure is about 1 GHz according to FIG. 28. The combined FSS-antenna shows a reduced 3-dB bandwidth of about 350 MHz which is only 50 percent of that of the antenna array alone and is much less than that of the FSS structure alone. To examine the bandwidth and the insertion loss characteristics of the FSS/antenna combination, the frequency response of the antenna and the FSS-antenna were measured up to 30°. FIG. 31 summarizes the 3-dB bandwidth and the excess loss as a function of angle.

It should be emphasized, however, that the exemplary FSS structure 202 used in this experiment is a single-pole surface and therefore has a limited selectivity. The example presented here, however, is only one potential embodiment. Multiple pole miniaturized element FSS structures or layers, other the exemplary one shown here, can be employed to construct antenna arrangement 200 and produce higher-order or multiple band filtering characteristics.

The exemplary antenna arrangement 200 described here may include an FSS layer 202 having a number of miniaturized elements and an antenna array 204 having a number of patches or other antenna elements, where the overall thickness of the antenna arrangement is very small and the antenna arrangement exhibits wide angular scanning capabilities. In this process, the FSS layer 202 may be overlaid on top of antenna array 204 though a foam or other dielectric spacer 226 to control or influence the electromagnetic radiations and/or receptions of the antenna array. The combined FSS structure 202 and dielectric spacer 226 may be referred to as a cover or superstrate. This method and arrangement can enable the fabrication of beamforming arrays comprising many closely-spaced antenna elements with lower cost. In this approach, the bandpass filters that are usually required in the transceiver chain of the individual elements of the beamforming system are eliminated and replaced with a single thin FSS structure or layer.

It is to be understood that the foregoing description is not a definition of the invention, but is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A frequency-selective surface (FSS) structure, comprising:

a conductive grid;

a plurality of conductive loops being located within the conductive grid and having uniform spacing (δ) between inner and outer edges of each loop, wherein the spacing (s) between the conductive loops and the conductive grid is on the order of λ/100 or less; and a thin substrate, wherein the conductive grid and the plurality of conductive loops are both located on the same side of the thin substrate and are arranged as a miniaturized element frequency-selective surface (MEFSS) with a plurality of unit cells whose dimensions are on the order of λ/10 or less, and the FSS structure exhibits a single pole frequency response.

2. The frequency-selective surface (FSS) structure of claim 1, wherein the conductive grid includes a plurality of square cells that each has a sub-wavelength outer dimension ($D_x$, $D_y$) on the order of λ/10 or less, each of the conductive loops is a square loop that has a sub-wavelength outer dimension on the order of λ/10 or less, and each of the conductive loops is located within the conductive grid such that the spacing (s) between the conductive grid and the conductive loops is uniform.

3. The frequency-selective surface (FSS) structure of claim 1, wherein the FSS structure does not include separate discrete capacitive and/or inductive elements connected to the plurality of conductive loops.

4. A frequency-selective surface (FSS) structure, comprising:

a first FSS layer having a first conductive grid and a first plurality of conductive loops, wherein the first conductive grid and the first plurality of conductive loops are both located on a first plane;

a second FSS layer having a second conductive grid and a second plurality of conductive loops, wherein the second conductive grid and the second plurality of conductive loops are both located on a second plane; and a thin substrate located between the first and second planes, wherein the first and second planes are spaced such that the first and second FSS layers are electromagnetically coupled to one another and at least one of the first and second FSS layers is arranged as a miniaturized element frequency-selective surface (MEFSS) with a plurality of unit cells whose dimensions are on the order of $\lambda/10$ or less, and the FSS structure exhibits a multiple pole frequency response.

5. The frequency-selective surface (FSS) structure of claim 4, wherein the first and second conductive grids each includes a plurality of square cells that each has a sub-wavelength outer dimension on the order of $\lambda/10$ or less, and the first and second pluralities of conductive loops each includes a plurality of square loops that each has a sub-wavelength outer dimension on the order of $\lambda/10$ or less.

6. The frequency-selective surface (FSS) structure of claim 4, wherein the first and second FSS layers are laterally shifted with respect to one another such that the FSS structure exhibits a higher order, multiple pole frequency response.

7. The frequency-selective surface (FSS) structure of claim 4, wherein the first and second FSS layers are not laterally shifted with respect to one another such that the FSS structure exhibits a multiple band, multiple pole frequency response.

8. The frequency-selective surface (FSS) structure of claim 4, wherein the thickness of the thin substrate is less than or equal to one hundredth of the wavelength ($\lambda/100$) of the electromagnetic signals being filtered such that the first and second FSS layers are highly coupled to one another.

9. A tunable frequency-selective surface (FSS) structure, comprising:

a first FSS layer having a first loop array;

a second FSS layer having a second loop array;

a thin substrate being located between the first and second FSS layers; and at least one bias network having a plurality of varactor diodes, wherein the first and second FSS layers are spaced such that the first and second loop arrays are electromagnetically coupled to one another, and the tunable FSS structure exhibits a frequency response that can be tuned with the bias network, and wherein the bias network includes at least one varactor diode that connects adjacent loops within the same loop array, at least one resistor that is connected in parallel with the varactor diode, and a power source that applies a voltage across the same loop array.

10. The tunable frequency-selective surface (FSS) structure of claim 9, wherein the first and second loop arrays each includes a plurality of square loops that each has a sub-wavelength outer dimension.

11. The tunable frequency-selective surface (FSS) structure of claim 9, wherein the first and second loop arrays have the same periodicity and are laterally shifted with respect to one another such that a loop corner of the first loop array is aligned with a loop center of the second loop array.

12. The tunable frequency-selective surface (FSS) structure of claim 9, wherein the tunable FSS structure exhibits a frequency response where an operational mode (bandpass versus bandstop), a center frequency and a bandwidth are all independently adjustable.

13. A tunable frequency-selective surface (FSS) structure, comprising:

a first FSS layer having a first conductive grid;

a second FSS layer having a second conductive grid;

a thin substrate being located between the first and second FSS layers; and a plurality of varactor diodes connecting the first and second conductive grids together, wherein the first and second FSS layers are spaced such that the first and second conductive grids are electromagnetically coupled to one another, and the FSS structure exhibits a frequency response that can be tuned without a bias network, and wherein the first and second conductive grids are connected to one another through one or more series connections that include a varactor diode, a horizontal link, and a vertical link, and the series connection both extends along a surface of the thin substrate and through the thin substrate.

14. The tunable frequency-selective surface (FSS) structure of claim 13, wherein the first and second conductive grids each includes a plurality of square cells that each has a sub-wavelength outer dimension.

15. The tunable frequency-selective surface (FSS) structure of claim 13, wherein the tunable FSS structure exhibits a frequency response where a center frequency and a bandwidth are independently adjustable.

16. An antenna arrangement, comprising:

a frequency-selective surface (FSS) structure having a loop array, a conductive grid, and a thin substrate, the loop array is located on one side of the thin substrate and the conductive grid is located on another side of the thin substrate;

an antenna array having a plurality of antenna elements; and a dielectric spacer located between the FSS structure and the antenna array, wherein the FSS structure is located over top of the antenna array such that electromagnetic waves incident upon or radiating from the antenna elements are filtered by the FSS structure.

17. The antenna arrangement of claim 16, wherein the loop array includes a plurality of square loops that each has a sub-wavelength outer dimension, and the conductive grid includes a plurality of square cells that each has a sub-wavelength outer dimension.

* * * * *